US009623999B2

(12) United States Patent
Boukobza et al.

(10) Patent No.: US 9,623,999 B2
(45) Date of Patent: Apr. 18, 2017

(54) DOUBLE-VALLEY PETALOID CONTAINER BOTTOM

(75) Inventors: Michel Boukobza, Octeville sur Mer (FR); Sylvain Meillerais, Octeville sur Mer (FR); Laurent Penet, Octeville sur Mer (FR)

(73) Assignee: SIDEL PARTICIPATIONS, Octeville sur Mer (FR)

( * ) Notice: Subject to any disclaimer, the term of this patent is extended or adjusted under 35 U.S.C. 154(b) by 0 days.

(21) Appl. No.: 14/110,308

(22) PCT Filed: Apr. 10, 2012

(86) PCT No.: PCT/FR2012/050779

§ 371 (c)(1),
(2), (4) Date: Dec. 13, 2013

(87) PCT Pub. No.: WO2012/140358

PCT Pub. Date: Oct. 18, 2012

(65) Prior Publication Data

US 2014/0103007 A1 Apr. 17, 2014

(30) Foreign Application Priority Data

Apr. 12, 2011 (FR) ..... 11 53190

(51) Int. Cl.
*B65D 1/02* (2006.01)

(52) U.S. Cl.
CPC ..... *B65D 1/0284* (2013.01)

(58) Field of Classification Search
CPC ..... B65D 1/0284; B65D 2501/0081
(Continued)

(56) References Cited

U.S. PATENT DOCUMENTS 4,249,667 A * 2/1981 Pocock et al. ..... 215/375
5,454,481 A * 10/1995 Hsu ..... 220/608
(Continued)

FOREIGN PATENT DOCUMENTS

EP 0 739 823 A1 10/1996
FR 2 772 720 A1 6/1999
(Continued)

*Primary Examiner* — Jeffrey Allen
*Assistant Examiner* — Jennifer Castriotta
(74) *Attorney, Agent, or Firm* — Sughrue Mion, PLLC

(57) ABSTRACT

Container made of plastic material comprising a body and a petaloid bottom (3) extending the body from a periphery (7), the bottom (3) comprising a bottom wall (4) that is generally convex toward the exterior, from which feet (5) protrude that define vertices (8) jointly forming a seat inscribed within a seating circle having a diameter (B) whose ratio is less than 4:5 with respect to the diameter (A) of the periphery (7), the feet (5) being spaced apart by portions of the bottom wall (4) forming hollow valleys (12) that extend radially from a central zone (6) of the bottom to the periphery (7), each valley (12) comprising two adjacent sections, namely:

a central section (17) that extends from the central zone (6) of the bottom (3) to a junction zone (18) situated directly below the seating circle, and which has, in a radial plane, a first radius of curvature (C);

a peripheral section (19), which extends from the junction zone (18) to the periphery (7), and which has, in said radial plane, a second radius of curvature (D), said peripheral section (19) being offset toward the exterior of the container (1) with respect to the central section (17), the junction zone (18) forming a step (20).

15 Claims, 4 Drawing Sheets

(58) Field of Classification Search
USPC ..... 215/373, 374, 375, 372; 220/608, 609, 220/604, 605
See application file for complete search history.

(56) References Cited

U.S. PATENT DOCUMENTS

| | | | | |
|---|---|---|---|---|
| 5,529,196 | A * | 6/1996 | Lane | 215/375 |
| 5,988,416 | A | 11/1999 | Cheng et al. | |
| 6,019,236 | A * | 2/2000 | Slat | 215/375 |
| 6,085,924 | A * | 7/2000 | Henderson | 215/375 |
| 6,213,325 | B1 * | 4/2001 | Cheng et al. | 215/375 |
| 7,083,059 | B1 * | 8/2006 | Le Guen | 215/375 |
| 2006/0175283 | A1 * | 8/2006 | Piccioli et al. | 215/375 |
| 2009/0308835 | A1 | 12/2009 | Boukobza | |
| 2010/0072165 | A1 * | 3/2010 | Schau | 215/371 |

FOREIGN PATENT DOCUMENTS

| | | |
|---|---|---|
| FR | 2 932 458 A1 | 12/2009 |
| GB | 2 098 167 A | 11/1982 |

* cited by examiner

DOUBLE-VALLEY PETALOID CONTAINER BOTTOM

The invention relates to the manufacture of containers, such as bottles, obtained by blowing or stretch-blowing blanks (preforms or intermediate containers) made of thermoplastic material.

A container is generally comprised of an open neck through which the contents (for example, a liquid) are inserted or extracted, a body, which gives the container its volume, and a bottom, which closes the body opposite the neck and forms a base intended to keep the container upright and in place when it is placed on a surface.

Containers intended for carbonated beverages, in which the pressure from the dissolved gas in the liquid produces significant mechanical stresses, are generally provided with bottoms in petaloid form: the bottom is comprised of projecting, petal-shaped feet separated by portions of convex wall, called "hollows" or "valleys," which extend radially from a central zone of the bottom. The feet are intended to ensure that the container maintains its position on a surface; the valleys are intended to absorb the stresses (thermal, mechanical) that the bottom undergoes (weight of the contents and/or stacked containers, if any).

It is known that the mechanical performance (that is, in practice, its rigidity) of a petaloid bottom increases with the height of the bottom due to the increase in the average height of the feet, i.e., the height of the projection that each foot forms with respect to the adjacent valleys. However, the "blowability" of the bottom, i.e., the ease with which the material can flow from the valleys toward the feet, decreases concomitantly.

Consequently, a compromise between mechanical performance and blowability is sought.

To date, the known solutions (see, in particular, French patent application FR 2 897 292 or its American equivalent, US 2009/020682) have not made it possible to obtain the best compromise.

Consequently, it seems desirable to perfect the known bottoms in this regard.

To that end, a container made of plastic material is proposed, comprised of a body and a petaloid bottom extending the body from a periphery. The bottom is comprised of a bottom wall that is generally convex toward the exterior, from which feet protrude that define vertices that jointly form a seat inscribed within a seating circle, which has a diameter whose ratio is less than 4:5 with respect to the diameter of the periphery. The feet are spaced apart by portions of the bottom wall, forming hollow valleys that extend radially from a central zone of the bottom to the periphery, while each valley of the container comprises two adjacent sections, namely:

- a central section that extends from the central zone of the bottom to a junction zone directly beneath the seating circle, and has, in a radial plane, a first radius of curvature;
- a peripheral section that extends from the junction zone to the periphery, and has, in said radial plane, a second radius of curvature, said peripheral section being offset toward the exterior of the container by an offset value with respect to the central section, the junction zone forming a step.

The step creates a discontinuity in the junction zone on the valleys. Thus, on the one hand, it makes it possible to increase the rigidity of the bottom. The position of the step makes it possible to improve the blowability at constant height of the bottom. On the other hand, the step makes it possible to decrease the height of the feet, i.e., the dimension measured axially from the seat, defining a seating plane, to the periphery.

This container can also include the following characteristics, taken separately or in combination:

- the ratio between the diameter of the seating circle and the diameter of the periphery is greater than 1:2;
- each step defines two successive inflection points, all of the steps together defining a first inflection circle and a second inflection circle, the diameter of the first inflection circle being smaller than the diameter of the second inflection circle;
- the ratio between the diameter of the seating circle and the diameter of the second inflection circle is between 1.3 and 0.7;
- the tangent to the first inflection point forms an angle with a vertical direction less than the angle formed by the tangent to the second inflection point with the vertical direction;
- the bottom is provided with radial grooves extending along the valleys;
- the value of the offset and the value of the first radius of curvature are such that their E:C ratio is between 1:100 and 1:25;
- the E:C ratio is about 1:50;
- the central section and the peripheral section have centers of curvature that do not merge;
- the central section and the peripheral section have different radii of curvature.

Other objects and advantages of the invention will be seen from the following description, provided with reference to the appended drawings, in which.

Figure 1:
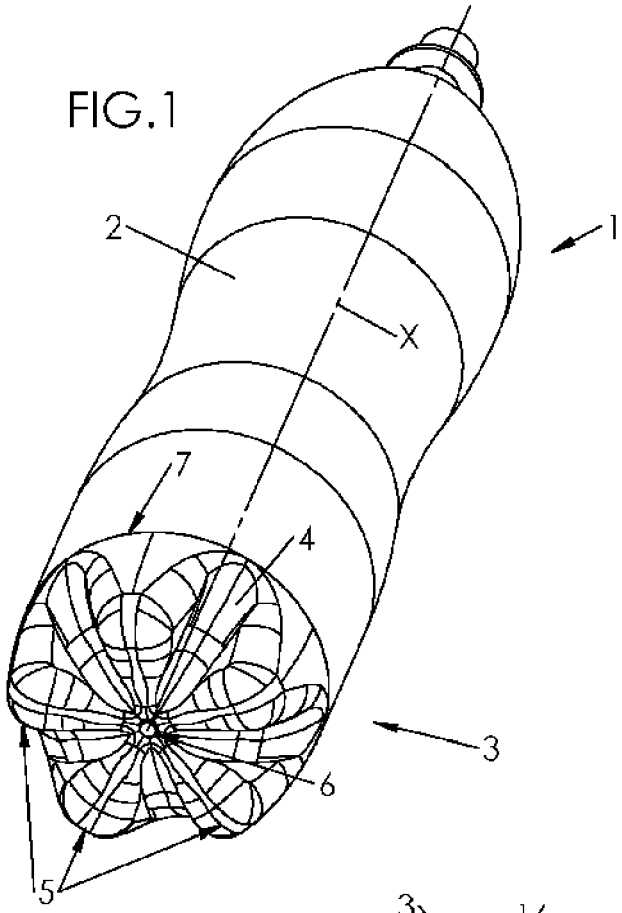
FIG. 1 is a view in perspective from below of a container with a petaloid bottom.

Represented in FIG. 1, in perspective from below, is a container 1—in this instance, a bottle—obtained by blowing or stretch-blowing a preform of previously heated thermoplastic material, for example polyethylene terephthalate (PET).

The container 1 extends along a principal axis X, defining a vertical direction and comprising a body 2, forming the side wall of the container 1, and a bottom 3, which extends the body 2 and closes said body at one of its lower ends, forming the lower wall of the container 1.

The bottom 3 is petaloid and is comprised of a bottom wall 4 that is generally convex in shape toward the exterior of the container 1 (i.e., downward when the container is set down flat).

The bottom 3 further comprises a series of feet 5 formed by excrescences protruding outward from the container 1, and which extend from a lozenge-shaped central zone 6 of the bottom 3, where the material remains substantially amorphous, toward a periphery 7 of the bottom 3, where the bottom connects with the body 2. A diameter of the periphery, denoted A, is defined as being the minimum diameter of the circle in which the periphery 7 is inscribed. According to the preferred embodiment illustrated in the figures, the periphery 7 is circular, with the understanding that the periphery 7 can be any shape.

Figure 2:
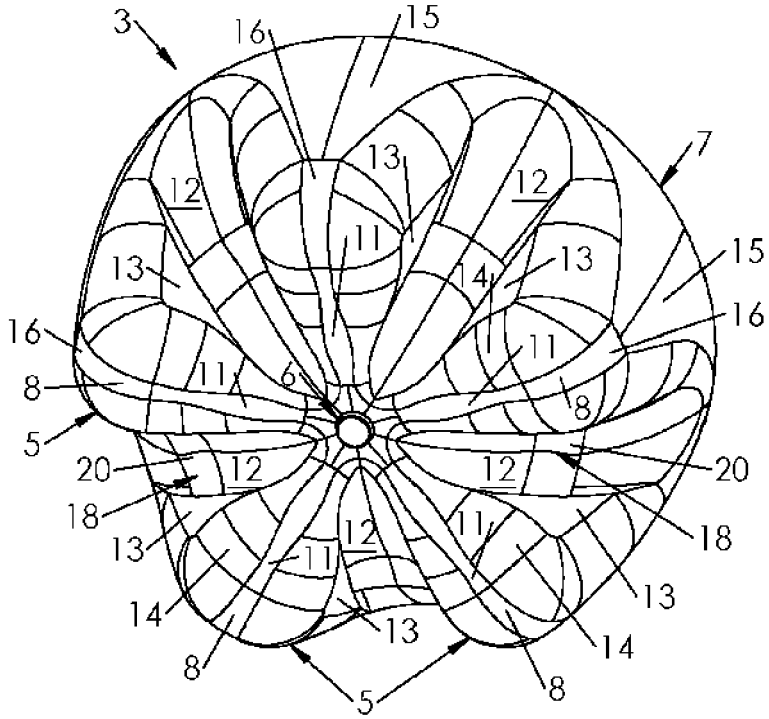
FIG. 2 is a view in larger scale of the bottom of the container of FIG. 1.
Figure 3:
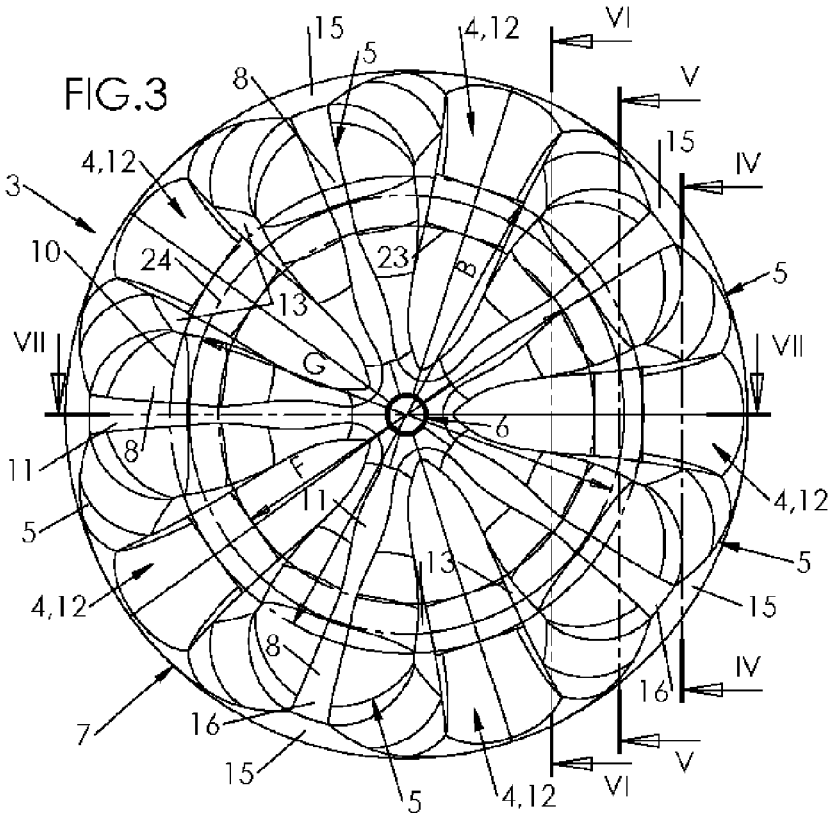
FIG. 3 is a plan view from below of the bottom of FIG. 2.

As can be clearly seen in FIGS. 2 and 3, the feet 5 become thinner from the interior toward the exterior of the container 1 (i.e., downward), and become wider from the central zone 6 toward the periphery 7.

The most prominent parts or vertices 8 of the feet 5 are included in a seating plane and jointly form a seat by which the container 1 can rest on a flat surface (for example, a table).

A seating circle 10 (represented in FIG. 3 by a broken line) is defined by the circle circumscribed at the vertices 8. In practice, the vertices 8 can have a certain thickness in the seating plane, so that the seating circle 10 can have a certain radial width (though small compared to the diameter of circle 10) and thus be ring-shaped. The diameter of the seating circle 10 is denoted B.

Figure 7:
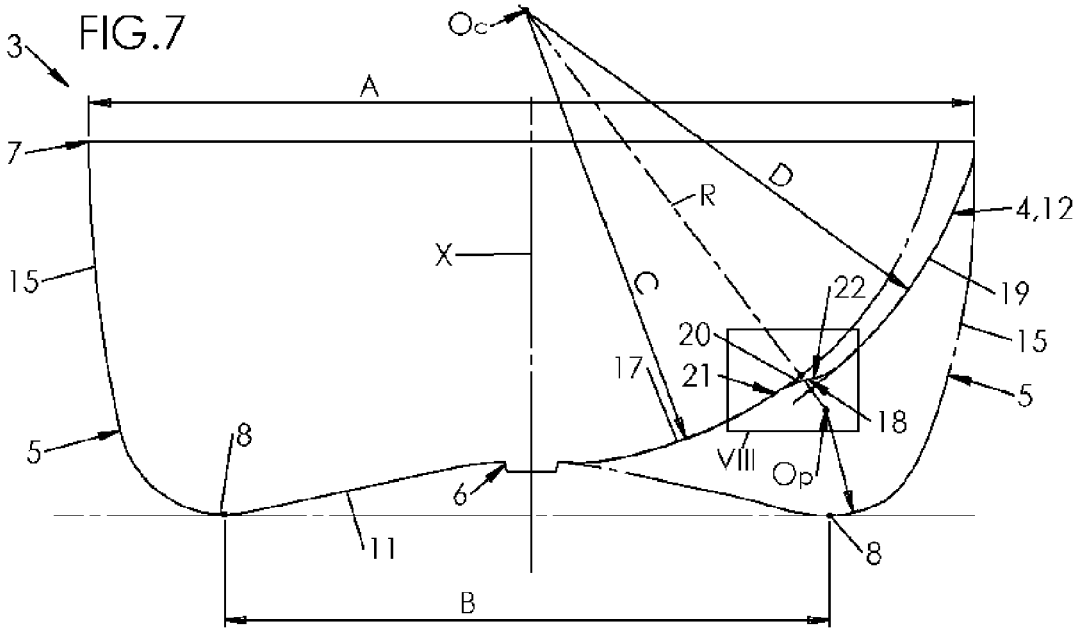
FIG. 7 is a cross-sectional view of the bottom of FIG. 3, along cutting plane VII-VII.
Figure 8:
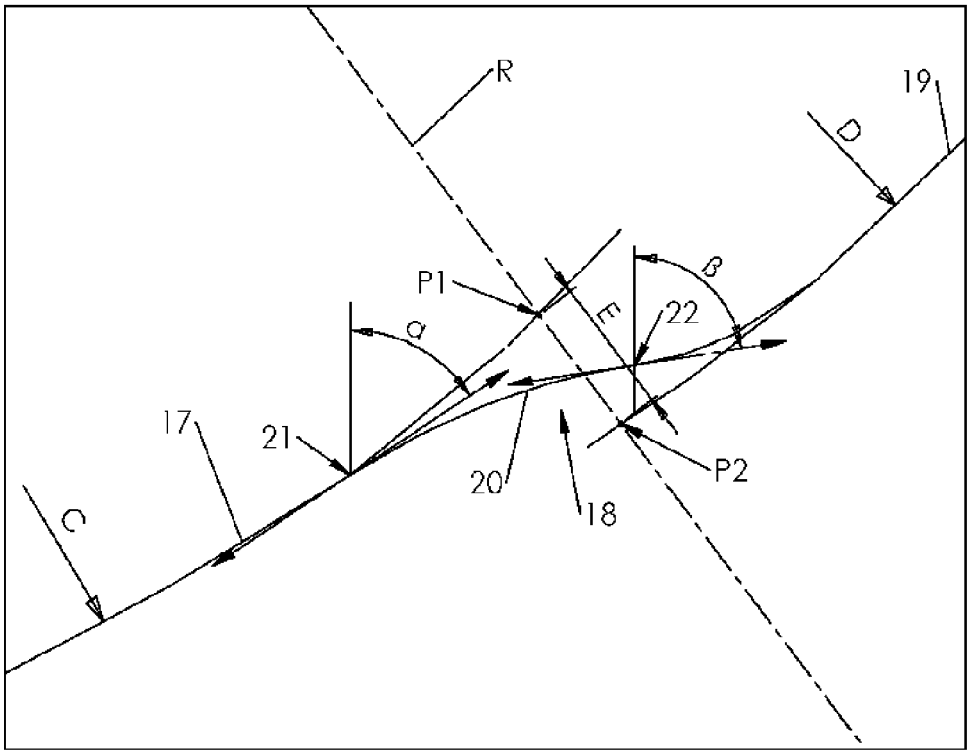
FIG. 8 is a detail view of FIG. 7.

Each foot 5 has an end face 11 that extends in a gentle slope from the central zone 6 of the bottom 3 toward the vertex 8, so that the foot 5 has a substantially triangular profile in radial cross-section (FIG. 7). More specifically, as illustrated in FIG. 7, the end face 11 is slightly curved, with a concavity toward the exterior of the container 1, the concavity becoming sharper near the central zone 6 of the bottom 3.

As can be clearly seen in FIGS. 2 and 3, the feet 5 are spaced apart by portions of the bottom wall 4, called valleys 12, which extend radially in a star shape from the central zone 6 to the periphery 7.

Figure 4:
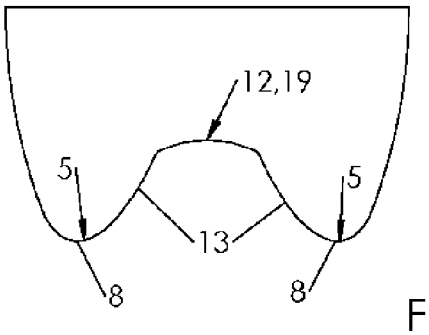
FIG. 4 is a partial cross-section of a detail of the bottom of FIG. 3, along cutting plane IV-IV.
Figure 5:
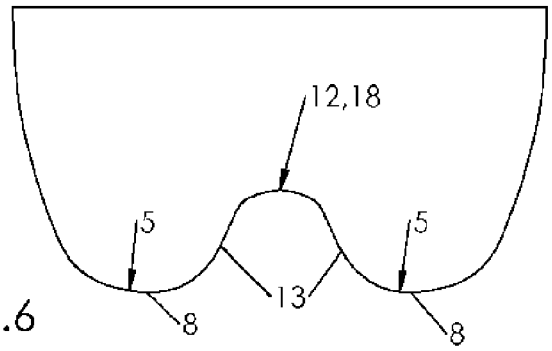
FIG. 5 is a partial cross-section of a detail of the bottom of FIG. 3, along cutting plane V-V.
Figure 6:
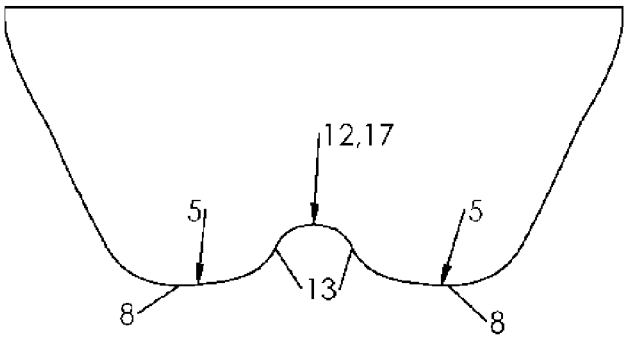
FIG. 6 is a cross-sectional view of the bottom of FIG. 3, along cutting plane VI-VI.

The valleys 12 are outwardly concave in transverse cross-section (i.e., along a plane perpendicular to the radial direction; see FIGS. 4 to 6). The radius of curvature of the valleys 12, measured in transverse cross-section, can be variable. More specifically, it is preferably small in proximity to the central zone 6, and relatively larger in proximity to the periphery 7.

It can be seen in FIGS. 3 to 6 that each valley 12 widens from the central zone 6 toward the periphery 7, which it joins. Said widening is preferably continuous, i.e., the edges of the valleys 12 form an angle between them that is not zero at any point. In the example shown, the valleys 12 in plan view have a tulip-shaped (or bell-shaped) contour, but this shape is not limiting, and the edges of the valleys 12 could be straight (the valleys 12 then having a V-shaped contour). As can be seen in particular in FIG. 2, each valley 12 has no branching (particularly of the side of the periphery 7), and thus forms a single hollow reserve.

It can be seen in FIGS. 2 and 3 that the number of feet 5 is equal to the number of valleys. In the example illustrated in the drawings, the bottom 3 comprises five feet 5 and five valleys 12, alternating regularly and distributed in a star shape. This number constitutes a good compromise; however, it could be lower (but greater than or equal to three) or higher (but preferably less than or equal to seven).

Each foot 5 has two substantially flat flanks 13, each of which laterally borders a valley 12. As can be seen in FIG. 4, the flanks 13 are not vertical (because the bottom 3 would then be difficult or even impossible to blow), but are sloped, opening out from the valley 12 toward the end face 11 of a foot. As illustrated in FIG. 3, the flanks 13 are connected to the end face 11 by a fillet 14.

Furthermore, each foot 5 is radially delimited by an outer face 15 that extends in the extension of the body 2 to the vicinity of the vertex 8, to which the outer face 15 is connected by a fillet 16. At the periphery of the bottom 3, the outer face 15 is connected to the body 2 by a fillet.

The outer face 15 is not cylindrical, but substantially conical in revolution around the axis X. More specifically, the outer face 15 is sloped toward the central zone 6 of the bottom 3 of the container 1 when approaching the seating plane. Moreover, in radial cross-section, the outer face 15 is not straight, but convex.

The vertices 8 of the feet 5 are thus offset toward the central zone 6 of the bottom 3, i.e., they are not level with the periphery 7. More specifically, the vertices 8 of the feet 5 are positioned so that the seating circle 10 is situated radially set back with respect to the periphery 7, i.e., with respect to the circle in which the periphery 7 is inscribed. Furthermore, the ratio between the diameter B of the seating circle 10 and the diameter A of the periphery 7 is less than 4:5.

Preferably, the ratio between the diameter B of the seating circle 10 and the diameter A of the periphery 7 is between 2:5 and 4:5, and even more preferably, the ratio between the diameters B and A is greater than 1:2, for example (as in the illustrated example), equal to about 7:10.

Moreover, as illustrated in FIG. 2, and at the right in FIG. 7, the valleys 12 have:

- a central section 17 that extends from the central zone 6 of the bottom 3 to a junction zone 18 situated directly below the seating circle 10, and which has, in a radial plane, a first radius of curvature C;
- a peripheral section 19, which extends from the junction zone 18 to the periphery 7, and which has, in said radial plane, a second radius of curvature D, said peripheral section 19 being offset toward the exterior of the container 1 with respect to the central section 17, the junction zone 18 forming a step 20.

The radii of curvature C and D are not necessarily constant, but can vary with the distance to the principal axis X. Furthermore, the centers of curvature of the sections 17 and 19 are not necessarily merged or located on the principal axis X of the container.

E denotes the offset value between the central section 17 and the peripheral section 19. Said offset E is defined in the following way.

A foot 5 and a valley 12 are considered in cross-section in the same radial plane (that of FIG. 7) by rotation around the principal axis X of the container 1. The center of curvature of the foot 5 at the vertex 8 is then denoted as $O_p$, and the center of curvature of the central section 17 as $O_c$. A reference axis R is drawn, joining the centers $O_p$ and $O_c$. The point of intersection of the reference axis R and the central section 17 is denoted as $P_1$, and the point of intersection of the reference axis R and the peripheral section 19 as $P_2$. If necessary, the central section 17 and the peripheral section 19 can be extended by extrapolation to determine the intersection points $P_1$ and $P_2$. The offset E is then considered to be equal to the distance between the intersection points $P_1$ and $P_2$.

The offset value E can be between 0.5 mm and 6 mm, depending on the capacities of the container 1. For example, for a container 1 with a capacity of 1.5 L, the offset E is between 0.8 mm and 2 mm.

Moreover, a ratio is defined between the offset E and the first radius C of curvature of the central section 17, which ratio is denoted E:C. The E:C ratio is then advantageously between 1:100 and 1:25 and is, for example, equal to 1:50, as in FIGS. 1 to 8.

The step 20 thus creates a discontinuity in the junction zone 18 on the valleys 12. More specifically, the step 20 defines two successive inflection points 21, 22: a first inflection point 21 at the change of concavity between the central section 17 and the junction zone 18, and a second inflection point 22 between the junction zone 18 and the peripheral section 19. Thus, each valley 12 has successively, in a radial plane:

- a first section (the central section 17), convex toward the exterior of the container 1;
- a second section (the junction zone 18), concave toward the exterior of the container 1; and
- a third section (the peripheral section 19), again convex toward the exterior of the container 1.

The first inflection point 21 is softer than the second inflection point 22, the angle $\alpha$ formed between the tangent to the first inflection point 21 and the vertical being smaller than the angle $\beta$ formed between the tangent to the second inflection point 22 and the vertical. By way of example, the angle $\alpha$ between the tangent to the first inflection point 21 and the vertical is between 40° and 65°, and for example is about 55°, while the angle $\beta$ between the tangent to the second inflection point 22 and the vertical is between 70° and 85°, and for example is about 80°.

The junction zone 18 is situated directly below the seating circle 10, i.e., the seating circle 10 and the junction zone 18, when viewed projected by rotation around the principal axis X in the same radial plane (that of FIG. 7), are substantially aligned along the vertical (parallel to the axis X). As with the seating circle 10, a first inflection circle 23 can be defined passing through the first inflection points 21 of the valleys 12 of the bottom 3, and a second inflection circle 24 can be defined passing through the second inflection points 22 of the valleys of the bottom 3 (which are illustrated by broken lines in FIG. 3). Obviously, given the position of the first inflection points 21 and second inflection points 22, the diameter F of the first inflection circle 23 is smaller than the diameter G of the second inflection circle 24.

Thus, preferably, in projection on the seating plane, the second inflection circle 24 is located between the central zone 6 of the bottom 3 and the seating circle 10. As a variant, the seating circle 10 can, for example, lie between the two inflection circles 23, 24. The ratio between the diameter B of the seating circle 10 and the diameter G of the second inflection circle 24 is preferably between 1.3 and 0.7, and is for example equal to about 1.1.

On the one hand, the step 20 makes it possible to increase the rigidity of the bottom. On the other hand, its position makes it possible to improve the blowability at constant height of the bottom 3.

Indeed, on the one hand, the stresses generated by an internal pressure in the container 1, for example, tend to accentuate the convexity of the valleys 12. The step 20, offering a sharp variation of curvature in the valleys 12, and more precisely by introducing a change of concavity between the peripheral section 19 and the central section 17, reduces the deformability of the valleys 12.

On the other hand, the step 20 allows the height of the feet 5 to be decreased, i.e., the dimension measured axially from the seating plane to the plane of the periphery 7. In other words, the feet 5 connect to the periphery 7 of the bottom 3 at a height that is less than that of the petaloid bottoms of the prior art for equivalent performance.

Indeed, the offset position toward the exterior of the container 1 of the peripheral section 19 with respect to the central section 17 (i.e., the presence of the step 20), combined with the position of the junction zone 18 directly below the seating circle 10, the peripheral section 19 joins the periphery 7 at a lower height than if the central section 17 were extended to the periphery 7.

In order to illustrate this phenomenon, the central section 17 is extended continuously in FIG. 7 (broken line at right). Thus, it can be clearly seen that if such an extension were actually made, it would necessitate offsetting upward the periphery 7 of the container 1. This would result in an increase of the height of the feet 5.

However, it appears that the blowability of the bottom 3, and more specifically of the feet 5, decreases when the height of the feet increases. From an experimental point of view, the material of the container in the process of being formed first reaches the imprints of the mold corresponding to the valleys 12. Upon contact with these imprints, the material cools, which instantaneously decreases its flow properties and increases the pressure required to force the material to reach the imprints of the mold corresponding to the vertices 8.

The offset, toward the exterior of the container 1, of the peripheral section 19 locally approaches the valleys 12 of the vertices 8, which decreases the time and/or blowing pressure necessary to reach the vertex 8 of the feet 5. It has been determined that when the step 20 is located substantially directly below the seating circle 10, whose diameter B has a ratio with the diameter A of the periphery 7 of less than 4:5, the mechanical performance of the bottom 3 remains satisfactory in spite of the decrease of the height of the feet 5 (and thus of the height of the bottom 3).

In order to further improve the mechanical performance of the bottom 3, the presence of the step 20 between the central section 17 and the peripheral section 19 can be combined with additional characteristics to rigidify the bottom 3.

Figure 9:
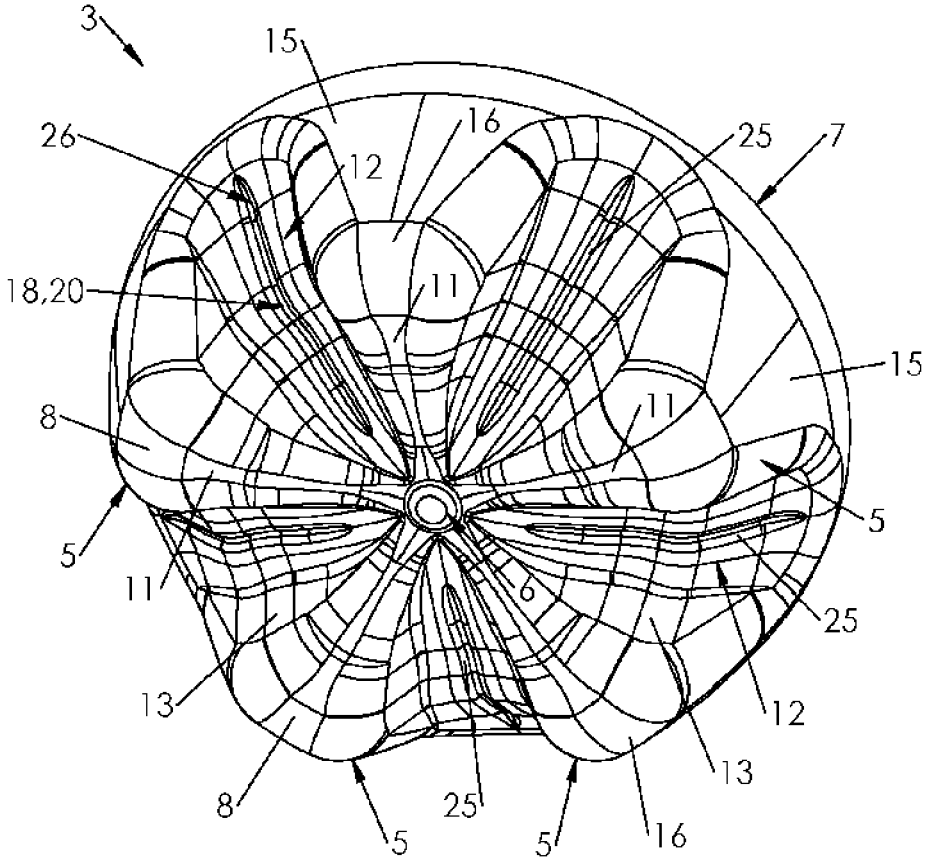
FIG. 9 is a view in perspective of a bottom according to another embodiment.

Thus, according to a first variant of embodiment shown in FIG. 9, the bottom 3 can be provided with radial grooves 25 that extend recessed toward the interior of the container 1, at the bottom of and along the valleys 12, along a median line of a valley 12, from the vicinity of the central zone 6 to the vicinity of the periphery 7. The function of the grooves 25 is to further increase the rigidity of the bottom 3. Under the effect of the mechanical stresses exerted on the container 1 (particularly under the effect of the pressure in the container filled with a carbonated liquid), the grooves 25 in effect tend to creep by expanding and flattening, which causes a widening of the valleys 12, resulting in a verticalization of the feet 5, which resists the overall sagging of the bottom 3.

Figure 10:
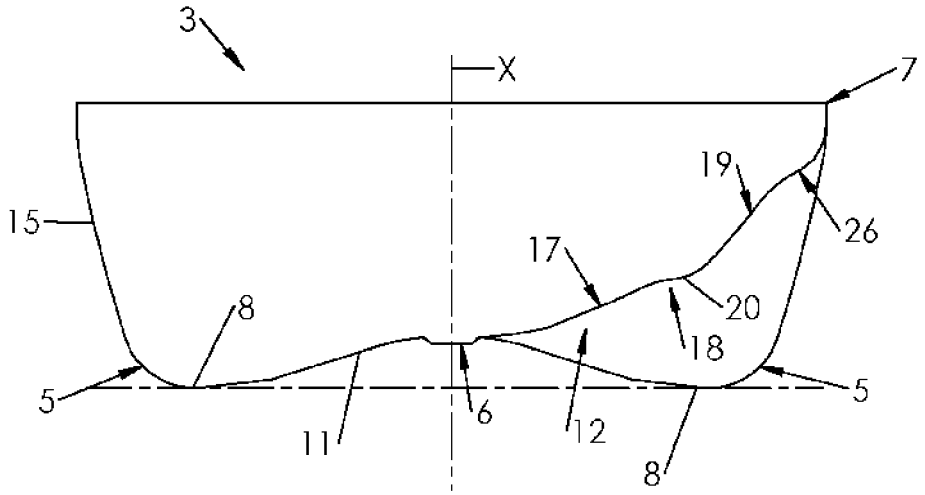
FIG. 10 is a view in radial cross-section of the bottom of FIG. 9.

According to a second variant of embodiment, the peripheral section 19 can be connected to the periphery 7 by means of an external section 26 (FIGS. 9 and 10) that is concave when there are no stresses, which increases the mechanical performance of the bottom 3. Indeed, under the effect of an internal pressure in the container 1, for example during the filling of the container 1, the central section 17 and the peripheral section 19, both convex, of each valley 12, tend to expand, while a reversal is observed of the external concave section 26, which then adopts a convex profile. The peripheral section 19 and the external section 26 then finally form a single, continuous, convex profile. It appears that this combined deformation exerts an axial force on the central zone 6 that is directed toward the interior of the container 1, which resists the effort produced by the hydrostatic thrust, to which is added the additional pressure due to the dissolved gas, thus limiting the sagging of the central zone 6.

Finally, according to a third variant of embodiment not represented in the figures, the feet 5 of the bottom 3 can be rigidified thanks to the formation of a protruding support edge, as described in the document FR 2 897 292 in the name of the applicant.

The combination of the central section 17, the step 20, the peripheral section 19 with the supplemental means for rigidifying the bottom 3, such as the grooves 25, the external section 26, or the protruding edge on the feet 5, ensures a good blowability of the bottom 3, while guaranteeing a good resistance of the bottom 3 to the mechanical stresses undergone by the container 1.

The invention claimed is:

1. A container made of plastic material comprising a body and a petaloid bottom extending the body from a periphery, the bottom comprising a bottom wall that is generally convex, from which feet protrude that define a seat inscribed within a seating circle having a diameter whose ratio is less than 4:5 with respect to a diameter of the periphery, the feet being spaced apart by portions of the bottom wall forming hollow valleys that extend radially from a central zone of the bottom to the periphery, wherein each valley of the container comprises the following three adjacent components:

a central section convex toward an exterior of the container and that extends from the central zone of the bottom, and which has, in a radial plane, a first radius of curvature;

a junction zone concave toward the exterior of the container, located directly above the seating circle;

a peripheral section convex toward the exterior of the container, which extends from the junction zone to the periphery, and which has, in said radial plane, a second radius of curvature, said peripheral section being offset toward the exterior of the container by an offset value with respect to the central section, the junction zone forming a step that defines two successive inflection points, a first inflection point at a change of concavity between the central section and the junction zone, and a second inflection point between the junction zone and the peripheral section;

the offset value being equal to a distance between a first intersection point and a second intersection point, the first intersection point being located at an intersection of a reference axis and the central section or an extension of the central section, the second intersection point being located at an intersection of the reference axis and the peripheral section or an extension of the peripheral section, the reference axis being a straight line joining a center of curvature of a corresponding foot of the container and a center of curvature of the central section.

2. The container according claim 1, wherein the seat is formed by vertices of the feet that define punctuated ends.

3. The container according to claim 1, wherein the peripheral section has a radius of curvature that is greater than a radius of curvature of the central section so as to offset the peripheral section relative to the central section.

4. The container according to claim 1, wherein the radius of curvature of the peripheral section and the radius of curvature of the central section have a common center.

5. The container according to claim 1, wherein an extrapolation of a lower end of the curvature of the peripheral section extends below the curvature of the central section.

6. The container according to claim 1, wherein the ratio between the diameter of the seating circle and the diameter of the periphery is greater than 1:2.

7. The container according to claim 1, wherein each step defines two successive inflection points, all of the steps together defining a first inflection circle and a second inflection circle, the diameter of the first inflection circle being smaller than the diameter of the second inflection circle.

8. The container according to claim 7, wherein the ratio between the diameter of the first seating circle and the diameter of the second inflection circle is between 1.3 and 0.7.

9. The container according to claim 7, wherein the tangent to the first inflection point forms an angle ($\alpha$) with the vertical that is smaller than an angle ($\beta$) formed by the tangent to the second inflection point with the vertical.

10. The container according to claim 1, wherein the bottom is provided with radial grooves extending along the valleys.

11. The container according to claim 1, wherein the offset value (E) and the value of the first radius of curvature (C) are such that their ratio E:C is between 1:100 and 1:25.

12. The container according to claim 11, wherein the ratio E:C is about 1:50.

13. The container according to claim 1, wherein the central section and the peripheral section have centers of curvature that do not merge.

14. The container according claim 1, wherein the central section and the peripheral section have different radii of curvature.

15. The container according to claim 1, wherein the offset value being in a range of 0.5 mm to 6 mm.

* * * * *